US005616990A

United States Patent [19]

Garbowicz et al.

[11] Patent Number: 5,616,990

[45] Date of Patent: Apr. 1, 1997

[54] BALLAST SCHEME FOR A FLUORESCENT LAMP WITH PREHEATED FILAMENTS

[75] Inventors: Glenn D. Garbowicz, Rosemont; Patrick E. Troy, Chicago; Janis L. Wetterich, Newark, all of Ill.

[73] Assignee: Philips Electronics North America Corporation, New York, N.Y.

[21] Appl. No.: 518,405

[22] Filed: Aug. 23, 1995

[51] Int. Cl.[6] ..... H05B 37/00

[52] U.S. Cl. ..... 315/103; 315/106; 315/289

[58] Field of Search ..... 315/106, 103, 315/289, 290

[56] References Cited

U.S. PATENT DOCUMENTS 3,553,526 1/1971 Moerkens et al. ..... 315/289

5,424,617 6/1995 Garbowicz et al. ..... 315/289

*Primary Examiner*—Robert Pascal
*Assistant Examiner*—Michael Shingleton
*Attorney, Agent, or Firm*—Edward Blocker; Bernard Franzblau

[57] ABSTRACT

A ballast for powering a fluorescent lamp with filaments requiring preheating. Control circuitry within the ballast delays an ignitor from being turned on until the filaments have been sufficiently preheated. The control circuitry is isolated and thereby protected from the high voltage pulses of the ignitor by an optocoupler. A SIDAC employed in the generation of the high voltage pulses is not relied upon for sensing full arc discharge of the lamp. The breakover voltage of the SIDAC can therefore be set at a much lower than conventional level resulting in the generation of more high voltage pulses over a prefixed period of time.

14 Claims, 3 Drawing Sheets

PARTS LIST

| BALLAST 10 | | | | BALLAST 15 | | |
|---|---|---|---|---|---|---|
| D1,D2,D3,D4 = | DIODE, | 1A, | 50V | D1 = DIODE, | 1A, | 50V |
| R1 = RESISTOR, | 100 KOHM, | | 2W | R1 = RESISTOR, | 5.8 KOHM, | 2W |
| R2 = RESISTOR, | 390 OHM, | | .25W | R2 = RESISTOR, | 390 KOHM, | .25W |
| R3 = RESISTOR, | 39 OHM, | | .25W | R3 = RESISTOR, | 39 OHM, | .25W |
| R4 = RESISTOR, | 4.3 OHM, | | .25W | R4 = RESISTOR, | 4.3 OHM, | .25W |
| R5 = RESISTOR, | 75 KOHM, | | .25W | R5 = RESISTOR, | 75 KOHM, | .25W |
| R6 = RESISTOR, | 390 KOHM | | .25W | R6 = RESISTOR, | 390 KOHM, | .25W |
| C1 = CAPACITOR, | 0.1 MICROFARAD, | | 400V | R7 = RESISTOR, | 1.5 KOHM, | .25W |
| C2 = CAPACITOR, | 330 MICROFARAD, | | 16V | C1 = CAPACITOR, | 0.2 MICROFARAD, | 400V |
| C3 = CAPACITOR, | 100 MICROFARAD, | | 16V | C2 = CAPACITOR, | 330MICROFARAD, | 16V |
| C4 = CAPACITOR, | 0.1 MICROFARAD, | | 50V | C3 = CAPACITOR, | 100 MICROFARAD, | 16V |
| Q1 = SIDAC, | 240 VBO | | | C4 = CAPACITOR, | 0.1 MICROFARAD, | 50V |
| Q2 = TRIAC, | 1A, | | 600V | C5 = CAPACITOR, | 0.15 MICROFARAD, | 600V |
| Q3 = TRANSISTOR, | 2N3904 | | | Q1 = SIDAC, | 190 VBO | |
| OC = OPTOISOLATOR, | MOC 3012 | | | Q2 = TRIAC, | 1A, | 200V |
| | | | | Q3 = TRANSISTOR, | 2N3904 | |
| | | | | Q4 = SIDAC, | 280 VBO | |
| | | | | Q5 = TRIAC, | 1A, | 600V |
| | | | | OC = OPTOISOLATOR, | MOC 3012 | |

FIG. 3

BALLAST SCHEME FOR A FLUORESCENT LAMP WITH PREHEATED FILAMENTS

BACKGROUND OF THE INVENTION

This invention relates generally to a ballast for starting a fluorescent lamp, and more particularly to an ignition scheme for igniting a fluorescent lamp following a predetermined period of time during which the lamp filaments are preheated.

Fluorescent lamps often require that their filaments (electrodes) be preheated prior to lamp ignition. Preheating is often controlled by an automatic switch commonly referred to as a starter. Once the filaments have been preheated, one or more large voltage pulses, generated by an ignitor, are applied to the fluorescent lamp filaments. These voltage pulses are commonly referred to as ignition pulses. Filaments are also frequently heated following ignition.

A starter typically includes two electrodes, at least one of which is bimetallic, enclosed in an argon/helium glass bulb. When the mains are switched on, a glow discharge starts between the electrodes. The heat from the glow discharge causes the bimetallic electrodes to bend toward and come into contact with each other. Current now flows through the electrodes and lamp filaments heating the latter. In the meanwhile, the glow discharge within the starter bulb has stopped allowing the electrodes to cool down and thereby separate from each other. When the electrodes separate, the relatively heavy current flowing through the inductive ballast and lamp filaments is interrupted. Voltage pulses in the order of 1000 volts, sufficient for lamp ignition, are now applied across the lamp filaments. In the event that the lamp does not ignite, the filaments are once again preheated prior to attempting to ignite the lamp.

The amount of heat applied to the lamp filaments prior to application of the ignition pulses thereto is critical in starting the lamp. In lamps that require preheating, it is difficult to start a lamp when the filaments have not been sufficiently preheated. Sputtering of the filaments during unsuccessful ignition can occur. Blackening of the fluorescent bulb and a decrease in lamp life often follows.

Starters, such as described above, do not sufficiently control the amount of heat being applied to the filaments prior to attempted ignition. More particularly, the amount of heat applied to the filaments varies based, in part, on the amount of time that the bimetallic elements remain in contact with each other. An unreliable ignition scheme with consequential sputtering of filament (emitter) material can result.

Ignition of the lamp also depends on the amount of energy within the high voltage (ignition) pulses generated by the ignitor. The amount of energy delivered to the lamp by the high voltage pulses can vary and depends, in part, on the number of high voltage pulses produced over a predetermined period of time. When an insufficient amount of energy is delivered to the lamp, the lamp will not ignite even though the filaments have been adequately preheated.

Accordingly, it is desirable to provide an improved ballast scheme in which the fluorescent lamp filaments are sufficiently preheated prior to turning on the ignitor. The ballast should, in particular, more precisely control the length of time that the filaments are preheated prior to attempted lamp ignition. Circuitry employed for controlling the length of time that the filaments are preheated should be isolated from the ignitor to protect the former from the high voltage levels generated by the latter. The improved ballast scheme also should generate ignition pulses having an overall higher energy level than generated by a conventional ignitor so as to provide a more reliable ignition scheme.

SUMMARY OF THE INVENTION

Generally speaking, in accordance with a first aspect of the invention, a ballast, which when connected to a power source, is operable for starting a lamp having filaments includes means for providing energy for heating the filaments, an ignitor and a control circuit. The control circuit includes a timer and an optocoupler coupled to the ignitor. The optocoupler is responsive to the timer for turning on the ignitor whenever the timer has timed out. The timer times out only after the filaments have been heated for a prefixed period of time.

Unlike conventional ballasts, the internal timer of the ballast control circuit more precisely controls the length of time that the filaments are preheated prior to attempted lamp ignition. Through the use of the optocoupler, the control circuit is isolated from the ignitor to protect the former from high voltage levels generated by the latter.

It is feature of the invention that the ignitor include a first bilateral switching device for enabling the ignitor in response to the conductive state of the optocoupler. The first bilateral switching device can be a first triac having a gate coupled to the optocoupler. The means for providing energy can include a transformer winding having a section coupled to the control circuit.

It is another feature in this first aspect of the invention that the ballast have a pair of output terminals and that the ignitor further include an additional bilateral switching device (e.g. SIDAC) coupled to the first bilateral switching device for deactivating the ignitor based on the voltage across the output terminals.

In accordance with a second aspect of the invention, the ignitor further includes a second bilateral switching device coupled to the first bilateral switching device. The second bilateral switching device activates and deactivates the ignitor based on the voltage across the output terminals.

It is a feature of this second aspect of the invention that the ballast further include a monitoring device for sensing the voltage across the output terminals and for triggering the second bilateral switching device into its conductive state in response to the sensed voltage. Typically, the second bilateral switching device is a triac having a gate and the monitoring device is a first SIDAC coupled to the gate of the triac. It is another feature of this second aspect of the invention that the ignitor further include a second SIDAC coupled to the first bilateral switching device. The first SIDAC has a breakover voltage higher than the breakover voltage of the second SIDAC. The lower breakover voltage of the second SIDAC permits more ignition pulses to ride on an open circuit voltage waveform when starting the lamp. The open circuit voltage waveform, that is, the voltage across the ballast output terminals prior to the lamp being lit results in more energy being supplied to the lamp. Ignition occurs more readily. Reduction in restrike required for successful ignition is minimized. A longer lamp life results.

In accordance with a third aspect of the invention, a method for operating a ballast includes the steps of generating voltages to be applied across the filaments of a lamp, generating ignition pulses from an ignitor for starting the lamp in response to a control signal and producing the control signal from a control circuit isolated from the ignitor.

The control signal is produced only after generating the voltages for a prefixed period of time.

It is a feature of this third aspect of the invention that the method further include enabling the ignitor by triggering a first bilateral device into its conductive state in response to the control signal. The control signal is produced within the control circuit in response to the conductive state of an optocoupler. Preferably, the method further includes activating the ignitor prior to being enabled by triggering a second bilateral device into its conductive state based on the voltage across a pair of output terminals of the ballast. In yet another feature of this third aspect of the invention, the method can also include deactivating the ignitor by triggering the second bilateral device into its nonconductive state based on the voltage across the output terminals of the ballast. In activating and deactivating the ignitor, the method further includes employing a SIDAC to sense the voltage across the output terminals of the ballast.

Accordingly, it is an object of the invention to provide an improved ignition scheme for more reliably starting a lamp.

It is another object of the invention to provide an improved fluorescent ballast which more precisely controls the length of time that the lamp filaments are preheated prior to attempted lamp ignition.

It is a further object of the invention to provide an improved fluorescent ballast in which circuitry employed for controlling the length of time that the filaments are preheated be isolated from the ignitor to protect the former from the high voltage levels generated by the ignitor.

It is still another object of the invention to provide an improved fluorescent ballast which generates ignition pulses having an overall higher energy level than is generated by a conventional ignitor so as to provide a more reliable ignition scheme.

Still other objects and advantages of the invention will, in part, be obvious, and will, in part, be apparent from the specification.

The invention accordingly comprises several steps in the relation of one or more such steps with respect to each of the others, and the device embodying features of construction, combination of elements and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a table listing nominal values of the components shown in FIGS. 1 and 2.

DETAILED DESCRIPTION OF THE PREFERRED EMBODIMENTS

Figure 1:
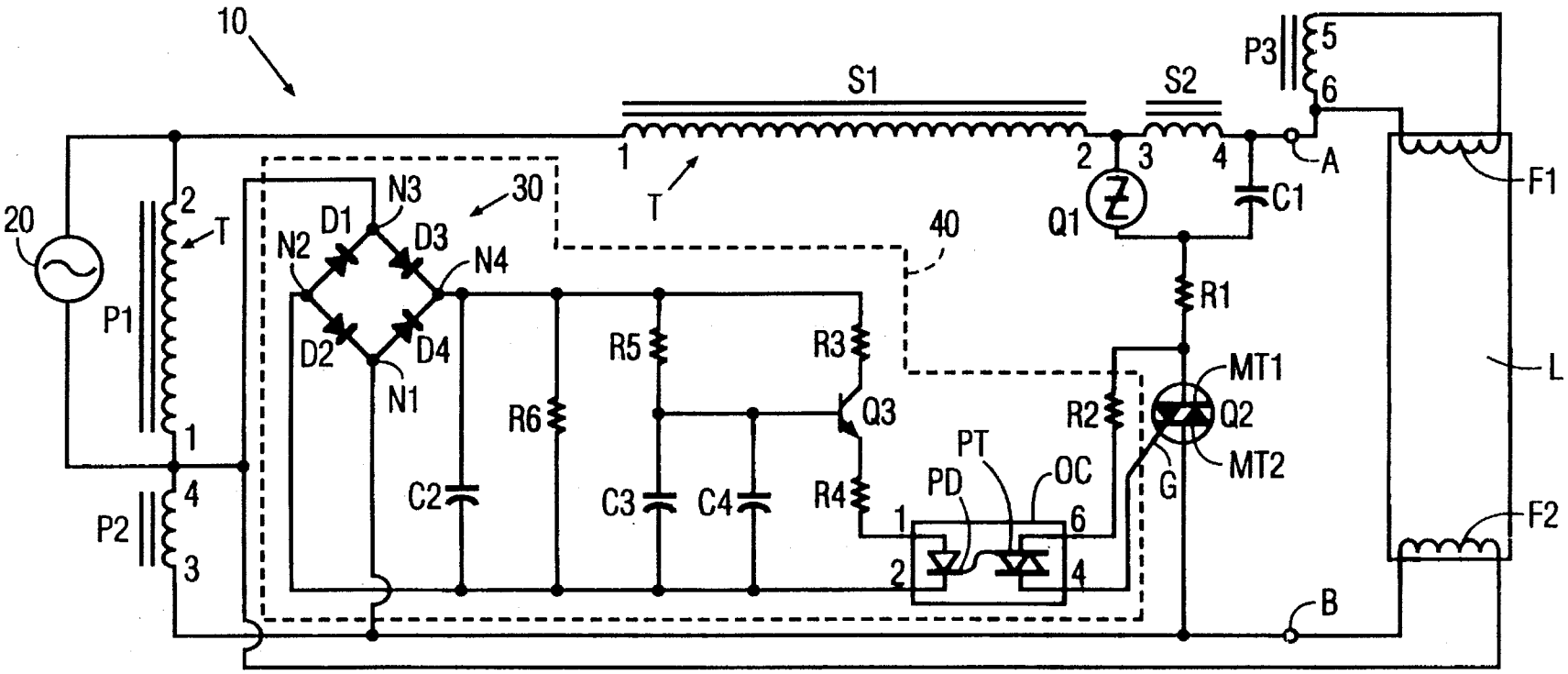
FIG. 1 is a schematic of a ballast in accordance with a first embodiment of the invention.

As shown in FIG. 1, a ballast 10 for powering a fluorescent lamp L is connected to an A.C. source 20. Ballast 10 includes an autotransformer T having a primary winding and a secondary winding. The primary winding includes three sections P1, P2 and P3. The secondary winding includes two sections S1 and S2. Section P1 is connected across A.C. source 20. Sections P2 and P3 are connected across and serve to precondition a pair of filaments F2 and F1, respectively.

Connected between the junction joining together sections S1 and S2 is a SIDAC Q1, that is, a bilateral switching device. The junction joining together sections S2 and P3 and a capacitor C1 serves as an output terminal A of ballast 10. A resistor R1 is connected to a junction joining together SIDAC Q1 and capacitor C1. Another bilateral switching device, that is, a triac Q2 is connected between resistor R1 and a junction serving as an output terminal B of ballast 10. The junction serving as output terminal B joins together section P2 and a node N1 of a diode bridge 30. Triac Q2 includes a main terminal MT1, a main terminal MT2 and a gate G. SIDAC Q1, capacitor C1, section S2, resistor R1 and triac Q2 in combination serve as an ignitor.

A gate drive 40 serving as a control circuit for turning on triac Q2 includes diode bridge 30, five resistors R2, R3, R4, R5 and R6, three capacitors C2, C3 and C4, a transistor Q3 and an optocoupler(optoisolator) OC. Diode bridge 30 includes four diodes D1, D2, D3 and D4. The anodes of diodes D1 and D2 are connected to a node N2. The cathodes of diodes D3 and D4 are connected to a node N4. The cathode of diode D1 and anode of diode D3 are connected to a node N3. The cathode of diode D2 and anode of diode D4 are connected to node N1. Capacitor C2, resistor R6 and the serial combination of resistor R5 and capacitor C3 are each connected together between nodes N2 and N4. Capacitors C3 and C4 are connected in parallel. The junction joining capacitors C3 and C4 and resistor R5 together is connected to the base of transistor Q3. A resistor R3 is connected between node N4 and a collector of transistor Q3. A resistor R4 is connected between an emitter of transistor Q3 and a pin 1 of optocoupler OC. A pin 2 of optocoupler OC is connected to node N2 of diode bridge 30. Optocoupler OC includes a photodiode PD connected between pins 1 and 2 and a phototriac PT connected between a pair of pins 4 and 6. Phototriac PT is a light activated bilateral switching element. Resistor R2 is connected between pin 6 of optocoupler OC and the junction joining together resistor R1 and main terminal MT1 of triac Q2.

Operation of ballast 10 is as follows. An AC voltage produced by A.C. source 20 is applied to section P1 of the primary winding which induces voltages across sections P2 and P3 of the primary winding and sections S1 and S2 of the secondary winding. The voltage applied to lamp L by output terminals A and B prior to ignition of lamp L is known as the open circuit voltage, that is, the voltage across lamp L during its open circuit condition. This open circuit voltage is insufficient to ignite lamp L. The induced voltages across sections P2 and P3 cause currents to flow through filaments F2 and F1 of lamp L, respectively, thereby heating the latter. Sections P2 and P3 serve to provide the energy necessary for heating of filaments F2 and F1, respectively.

The voltage across section P2 of the primary winding is rectified by diode bridge 30 resulting in a rectified A.C. signal between nodes N2 and N4. Capacitor C2 substantially removes the ripple from and thereby smooths the rectified A.C. signal. Resistor R6 serves to discharge the capacitors within gate drive 40. A substantially smooth D.C. voltage is applied across the serial combination of resistor R5 and capacitor C3. Resistor R5 and capacitor C3 serve as the RC timer of gate drive 40. Once this RC timer has timed out, capacitor C3 is sufficiently charged to turn on transistor Q3. Current now flows through photodiode PD of optocoupler OC. Capacitor C4 serves to dampen emitter voltage oscillations once transistor Q3 is turned on. Resistor R3 limits the level of current flowing through the collector of transistor Q3 and dampens emitter voltage oscillations. Resistor R4 serves to limit the current flowing through photodiode PD.

Photodiode PD and phototriac PT are optically coupled together. Current flowing through photodiode PD triggers phototriac PT into its conductive (ON) state. Resistor R2 limits the maximum surge current fed through phototriac PT. The current flowing through phototriac PT into gate G is limited predominantly by resistor R2 and is sufficient to turn on triac Q2.

The ignitor is enabled once triac Q2 is turned on. More particularly, once triac Q2 is turned on, the open circuit voltage between output terminals A and B is placed across the serial combination of capacitor C1, resistor R1 and triac Q2 resulting in the charging of capacitor C1. The voltage across capacitor C1 increases until the breakover voltage of SIDAC Q1 is reached. Capacitor C1 now rapidly discharges through section S2 of the secondary winding. By transformer action, the voltage pulse produced during discharge of capacitor C1 is stepped up by transformer T to provide an ignition pulse across output terminals A and B for igniting lamp L. Following discharge, capacitor C1 once again begins to charge until reaching the breakover voltage of SIDAC Q1. Capacitor C1 will once again rapidly discharge resulting in the generation of an ignition pulse applied to lamp L. The foregoing sequence of charging and discharging of capacitor C1 resulting in the generation of an ignition pulse continues until lamp L ignites. Once lamp L ignites, the voltage between output terminals A and B drops well below the breakover voltage of SIDAC Q1. Generation of an ignition pulse based on the voltage across capacitor C1 exceeding the breakover voltage of SIDAC Q1 is no longer possible. The ignitor through SIDAC Q1 is therefore effectively deactivated.

As can now be readily appreciated, the ignitor is turned on only after the RC timer within gate drive 40 has timed out. The timer is set to time out only after filaments F1 and F2 have been sufficiently preheated. Gate drive 40 through use of optocoupler 0C isolates the high voltage pulses generated by the ignitor from the logic controlling the delayed turn on of the ignitor. In other words, gate drive 40 provides precise control of when triac Q2 is turned on thereby permitting adequate preconditioning of filaments F1 and F2.

In the event that power from A.C. source 20 applied to section P1 of the primary winding is discontinued, capacitors C2, C3 and C4 discharge. The RC timer of resistor R5 and capacitor C3 is effectively allowed to reset. Accordingly, whenever power from A.C. source 20 applied to section P1 is temporarily interrupted, the RC timer of gate drive 40 will delay turning on the ignitor again. Filaments F1 and F2 are once again permitted to be sufficiently preheated prior to enabling the ignitor by switching triac Q2 to its conductive state.

Figure 2:
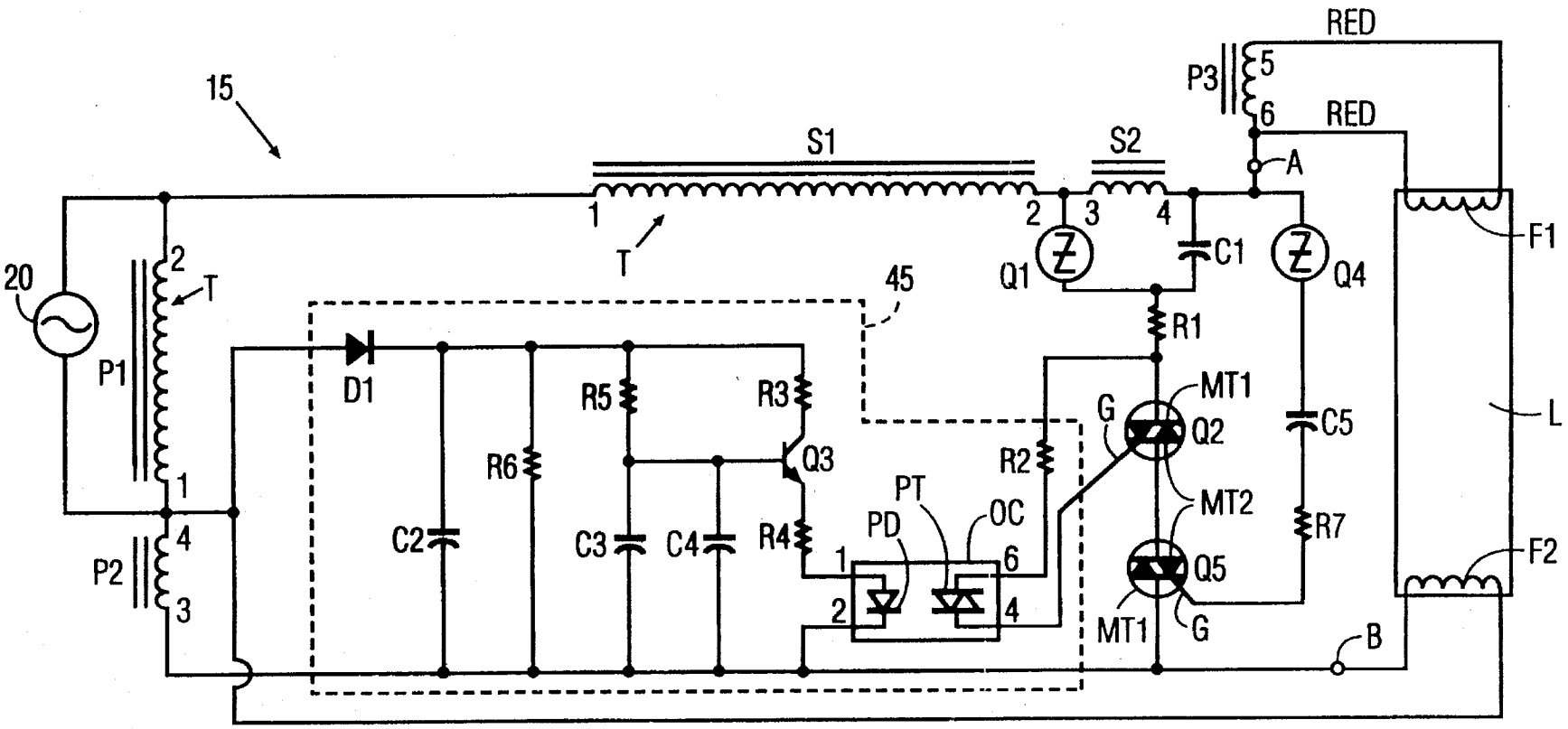
FIG. 2 is a schematic of a ballast in accordance with an alternative embodiment of the invention.

A ballast 15 in accordance with an alternative embodiment of the invention is shown in FIG. 2. The elements in FIGS. 1 and 2 identical in construction and operation are identified by like reference numerals and will not be further discussed hereinafter. As shown in FIG. 2, a gate drive 45 serving as a control circuit for triac Q2 includes a diode D1 for rectification of the A.C. voltage supplied by section P2 to gate drive 45. The anode of diode D1 is connected to the junction joining together sections P1 and P2. The cathode of diode D1 is connected to the junction joining together capacitor C2 and resistors R3, R5 and R6. A junction serving as output terminal B of ballast 15 joins together section P2, capacitors C2, C3 and C4, resistor R6, pin 2 of optocoupler OC and a main terminal MT1 of a triac Q5. Similar to diode bridge 30 of FIG. 1, diode D1 provides a rectified A.C. voltage to capacitor C2 for removing ripple therefrom by the latter.

The ignitor of ballast 15 includes SIDAC Q1, a SIDAC Q4, section S2 of the secondary winding, capacitor C1, a capacitor C5, resistor R1, a resistor R7 and triacs Q2 and Q5. A serial combination of SIDAC Q4, capacitor C5 and resistor R7 connected between output terminal A and a gate G of triac Q5 provides the driving current for turning on triac Q5. A main terminal MT2 of triac Q5 is connected to main terminal MT2 of triac Q2. In other words, bilateral switching devices Q2 and Q5 are serially connected to each other.

SIDAC Q4 has a breakover voltage greater than the operating voltage of lamp L, that is, greater than voltage of lamp L once the latter has ignited. SIDAC Q1 can have a breakover voltage less than the operating voltage of Lamp L. The breakover votages of SIDACs Q1 and Q4 are also each less than the open circuit voltage of lamp L. SIDAC Q4, however, has a higher breakover voltage than SIDAC Q1. In accordance with this alternative embodiment, SIDAC Q1 is now only used in the generation of ignition pulses. Unlike ballast 10 of FIG. 1, triac Q5 rather than SIDAC Q1 is used to turn off the ignitor. Triac Q5 is essentially a switch for activating the ignitor only during open circuit conditions of lamp L and for deactivating the ignitor once the lamp is lit (i.e. in full arc discharge). Enabling of the ignitor remains subject to the time delay imposed by the RC timer (i.e. resistor R5 and capacitor C3) of gate drive 45.

SIDAC Q4 serves as a gate trigger sensor for triac Q5. In particular, SIDAC Q4 senses when lamp L is in its open circuit and steady state/post ignition conditions. During open circuit conditions, SIDAC Q4 breaksover which permits current to flow into gate G of triac Q5° turning on the latter. When triac Q5 is first turned on (switched to its conductive state), the voltage across output terminals A and B is insufficient to ignite lamp L. Concurrently, filaments F1 and F2 are being preheated by sections P3 and P2, respectively. After the RC timer has timed out, triac Q2 switches to its conductive state. Triacs Q2 and Q5 are now both turned on. Capacitor C1 now charges and discharges as discussed above in connection with ballast 10 resulting in the generation of ignition pulses until lamp L ignites. Once lamp L is lit, the voltage across SIDAC Q4 is insufficient to maintain the latter in its conductive state. Current no longer flows into gate G of triac Q5. Triac Q5 now switches to its nonconductive state resulting in the ignitor being turned off (deactivated).

SIDAC Q1 has a lower breakover voltage when used within the ignition scheme of ballast 15 than when used within the ignition scheme of ballast 10. The lower breakover voltage of SIDAC Q1 within ballast 15 is provided through the use of SIDAC Q4 in sensing the change from open circuit to steady state operating conditions of lamp L. The change in operating conditions sensed by SIDAC Q4 results in triac Q5 switching from its conductive to nonconductive states which in turn shuts off the ignitor. Triac Q5 serves to activate and deactivate the ignitor. In contrast thereto, SIDAC Q1 within the ignition scheme of ballast 10 is used to both sense the change in these operating conditions of lamp L and to turn off (deactivate) the ignitor.

The breakover voltage of SIDAC Q1 within the ignition scheme of ballast 10 must be sufficiently high to avoid false triggering. In contrast thereto, the breakover voltage of SIDAC Q1 within ballast 15 can be much lower since SIDAC Q4 rather than SIDAC Q1 protects the ignitor from false triggering. The lower breakover voltage of SIDAC Q1 permits more ignition pulses to ride on the open circuit voltage waveform (i.e. with triacs Q2 and Q5 closed). More energy is therefore supplied by ballast 15 than ballast 10 to lamp L when starting the latter. A more reliable ignitor results. The overall higher energy level of ignition pulses is applied to lamp L after filaments F1 and F2 have been sufficiently preheated (preconditioned).

In accordance with another alternative embodiment of the invention, the RC timer in either of the foregoing embodiments can be replaced with a precision timer IC such as, but not limited to, the precision timer IC disclosed in U.S. Pat. No. 5,424,617, the disclosure of which is incorporated herein by reference thereto. Such precision timer controls the time delay in turning on the ignitor.

As can now also be readily appreciated, gate drives 40 and 45 of ballasts 10 and 15, respectively, through use of optocoupler OC isolate the high voltage pulses generated by the ignitor from the logic controlling the delayed turn on of triac Q2. The delayed turn on permits preheating of filaments F1 and F2. Furthermore, triac Q5 of ballast 15, by controlling when the ignitor is deactivated permits the breakover voltage of SIDAC Q1 to be lowered. The greater number of ignition pulses riding on the open circuit voltage waveform applied to lamp L when attempting to start the latter results in a more reliable ignitor.

A table listing the nominally rated component values in accordance with both embodiments of the invention described heretofore is set forth in FIG. 3. The component values listed in FIG. 3 are suitable for ballasting a fluorescent lamp nominally rated at 26 or 32 watts.

Ballasts 10 and 15 provide a relatively simple approach in the design of a time delayed ignitor. Conventional fluorescent ballasts often provide an imprecise time delay prior to attempted ignition to permit preheating of the lamp filaments. Ballasts 10 and 15, however, provide precise control of when the ignitor is to be turned on to ensure adequate preconditioning of filaments F1 and F2. Advantageously, this precise control is provided through gate drives 40 and 45 both of which use an optocoupler OC to isolate the control logic from the high voltages generated by the ignitor.

It will thus be seen that the objects set forth above and those made apparent from the preceding description, are efficiently attained and since certain changes can be made in the above construction without departing from the spirit and scope of the invention, it is intended that all matter contained in the above description and shown in the accompanying drawings shall be interpreted as illustrative and not in a limiting sense. For example the invention can be used not only for preheat but also rapid start applications.

It is also to be understood that the following claims are intended to cover all the generic and specific features of the invention herein described and all statements of the scope of the invention which, as a matter of language, might be said to fall therebetween.

What is claimed is:

1. A ballast which when connected to a power source is operable for powering a lamp having filaments, comprising:

a pair of output terminals;

means for providing energy for heating the lamp filaments;

an ignitor which includes a first bilateral switching device for enabling the ignitor and a second bilateral switching device coupled to the first bilateral switching device for deactivating the ignitor based on a voltage across the output terminals; and a control circuit including a timer and an optocoupler coupled to the ignitor, the optocoupler being responsive to the timer for turning on the ignitor whenever the timer has timed out, wherein the timer times out only after the filaments have been heated for a prefixed period of time and the first bilateral switching device enables the ignitor in response to the conductive state of the optocoupler.

2. The ballast of claim 1, wherein the first bilateral switching device is a first triac having a gate coupled to the optocoupler.

3. The ballast of claim 2, wherein the second bilateral switching device is serially connected to the first bilateral switching device, the second bilateral switching device for activating the ignitor based on the voltage across the output terminals.

4. The ballast of claim 3, further including a monitoring device for sensing the voltage across the output terminals and for triggering the second bilateral switching device in response to the sensed voltage.

5. The ballast of claim 4, wherein the second bilateral switching device is a second triac having a gate and the monitoring device is a first SIDAC coupled to the gate of the second triac.

6. The ballast of claim 5, wherein the ignitor further includes a second SIDAC coupled to the first bilateral switching device, the first SIDAC having a breakover voltage higher than the breakover voltage of the second SIDAC.

7. The ballast of claim 1, wherein the second bilateral switching device is a SIDAC.

8. A ballast which when connected to a power source is operable for powering a lamp having filaments, comprising:

means for providing energy for heating the lamp filaments;

an ignitor which includes a first bilateral switching device for enabling the ignitor and a second bilateral switching device coupled to the first bilateral switching device, the second bilateral switching device activating and deactivating the ignitor based on the voltage across the output terminals, and the first bilateral switching device enables the ignitor in response to the conductive state of the optocoupler.

9. The ballast of claim 8, further including a monitoring device for sensing the voltage across the output terminals and for triggering the second bilateral switching device into its conductive state in response to the sensed voltage.

10. The ballast of claim 9, wherein the second bilateral switching device is a triac having a gate and the monitoring device is a first SIDAC coupled to the gate of the triac.

11. The ballast of claim 10, wherein the ignitor further includes a second SIDAC coupled to the first bilateral switching device, the first SIDAC having a breakover voltage higher than the breakover voltage of the second SIDAC.

12. A method for operating a ballast comprising the steps of:

generating voltages to be applied to the filaments of a lamp;

generating ignition pulses from an ignitor for starting the lamp in response to a control signal;

producing the control signal from a control circuit isolated from the ignitor, the control signal being produced only after generating said voltages for a prefixed period of time, enabling the ignitor by triggering a first bilateral device into its conductive state in response to the control signal, the control signal being produced within the control circuit in response to the conductive state of an optocoupler, and activating the ignitor prior to its being enabled by triggering a second bilateral device into its conductive state based on the voltage across a pair of output terminals of the ballast.

13. The method of claim 12, further including deactivating the ignitor by triggering the second bilateral device into its nonconductive state based on the voltage across the output terminals of the ballast.

14. The method of claim 12, wherein the steps of activating and deactivating include sensing by a SIDAC of the voltage across the output terminals of the ballast.

* * * * *